United States Patent [19]

Weiss

[11] 4,314,127

[45] Feb. 2, 1982

[54] MICROWAVE OVEN WITH ROTATING MULTIPORT RADIATOR

[75] Inventor: Bernard J. Weiss, Barto, Pa.

[73] Assignee: Raytheon Company, Lexington, Mass.

[21] Appl. No.: 94,135

[22] Filed: Oct. 24, 1979

Related U.S. Application Data

[63] Continuation of Ser. No. 847,863, Nov. 2, 1977, abandoned.

[51] Int. Cl.[3] ..... E05B 6/72

[52] U.S. Cl. ..... 219/10.55 F

[58] Field of Search ..... 219/10.55 F, 10.55 B, 219/10.55 M

[56] References Cited

U.S. PATENT DOCUMENTS

| | | | |
|---|---|---|---|
| 3,643,055 | 2/1972 | Suzuki et al. | 219/10.55 F |
| 3,746,823 | 7/1973 | Whiteley | 219/10.55 F |
| 3,851,133 | 11/1974 | Dygve et al. | 219/10.55 F |
| 4,028,521 | 6/1977 | Uyeda et al. | 219/10.55 B X |
| 4,053,730 | 10/1977 | Baron et al. | 219/10.55 F |
| 4,137,442 | 1/1979 | Tateda | 219/10.55 B |
| 4,176,266 | 11/1979 | Kaneko et al. | 219/10.55 F |

FOREIGN PATENT DOCUMENTS

| | | | |
|---|---|---|---|
| 676266 | 6/1966 | Belgium | 219/10.55 F |
| 2622173 | 12/1976 | Fed. Rep. of Germany | 219/10.55 F |
| 52-58143 | 5/1977 | Japan | 219/10.55 F |

*Primary Examiner*—Fred L. Braun
*Assistant Examiner*—Keith E. George
*Attorney, Agent, or Firm*—Milton D. Bartlett; Joseph D. Pannone; Herbert W. Arnold

[57] ABSTRACT

A combination electric heat and microwave oven employing a common cavity for cooking food with either microwave energy, electric resistance heating, or both in which the oven is supplied with microwave energy through a rotating multi-port radiator having a plenum fed from a magnetron through a waveguide and a coaxial line whose outer conductor extends into the plenum and whose central conductor supports said radiator.

11 Claims, 4 Drawing Figures

MICROWAVE OVEN WITH ROTATING MULTIPORT RADIATOR

CROSS-REFERENCE TO RELATED CASES

This is a continuation of application Ser. No. 847,863, filed Nov. 2, 1977 now abandoned.

Application Ser. No. 754,064, assigned to the same assignee as this application, is hereby incorporated by reference and made part of this disclosure.

BACKGROUND OF THE INVENTION

In the aforementioned copending application, there is disclosed a combination microwave oven using a rotating radiator for microwave energy with provision for supplying resistance heat by heating elements positioned around the rotating radiator. However, such an oven was made relatively expensive by using a belted drive to rotate the radiator and by using an individually machined waveguide to coaxial line transition structure.

In addition, substantial radiation of energy between the rotating radiator and the adjacent wall of the oven reduced the energy radiated directly into the body to be heated.

SUMMARY OF THE INVENTION

In accordance with this invention, there is provided a microwave oven which more efficiently couples microwave energy into a body to be heated with a plurality of simultaneously radiated patterns.

More specifically, this combination discloses that the output of a magnetron may be impedance matched into coaxial line in a manner such that the standing wave ratio on the line may be substantially a multi-port unity. Specifically, this is achieved by forming a waveguide thorugh which the magnetron output is coupled to the coaxial line with an impedance transition of substantially conical shape formed of stamped sheet metal surrounding the central conductor of the coaxial line.

In accordance with this invention, the waveguide to coaxial line transition is spaced in waveguide from the output of said magnetron, and from the ends of said waveguide by distances greater than one-half wavelength of the energy in said guide.

In addition, the outer conductor of the coaxial transmission line extends through the oven wall and into the plenum of a rotating radiator having a plurality of ports radiating microwave energy into the oven in a plurality of simultaneous radiation patterns whose axes are substantially parallel to the axis of rotation of said radiator and whose axes are spaced at different distances from said axis of rotation.

In accordance with this invention, a food body is positioned on a rack in the radiation patterns from the rotating radiator so that a substantial portion of the microwave energy is absorbed on passing through the food body first time prior to reflection from walls of the oven. Therefore, high efficiency heating may be achieved with microwave energy even though the walls of the oven are made of inexpensive material such as enamelled steel. In accordance with this invention, the magnetron may be tightly coupled to the oven through a coupling mechanism such as a waveguide and coaxial transition thereby increasing the efficiency of conversion of input power electrical energy to microwave energy coupled into the body to be heated. More specifically, in the case of light loads or if the oven is energized, with no food body positioned therein, microwave energy radiation into the oven and reflected back to a multi-port rotating radiator from the opposite wall such as the top wall of the oven will arrive at a common junction such as the central conductor of a coaxial line transition with substantially different phases so that relatively low amounts of energy are coupled back into the magnetron and large portions of the energy are reflected back into the oven where the energy is absorbed by the walls of the oven.

BRIEF DESCRIPTION OF THE DRAWINGS

Other and further objects and advantages of this invention will be apparent as the description thereof progresses reference being had to the accompanying drawings wherein.

DESCRIPTION OF THE PREFERRED EMBODIMENT

Figure 1:
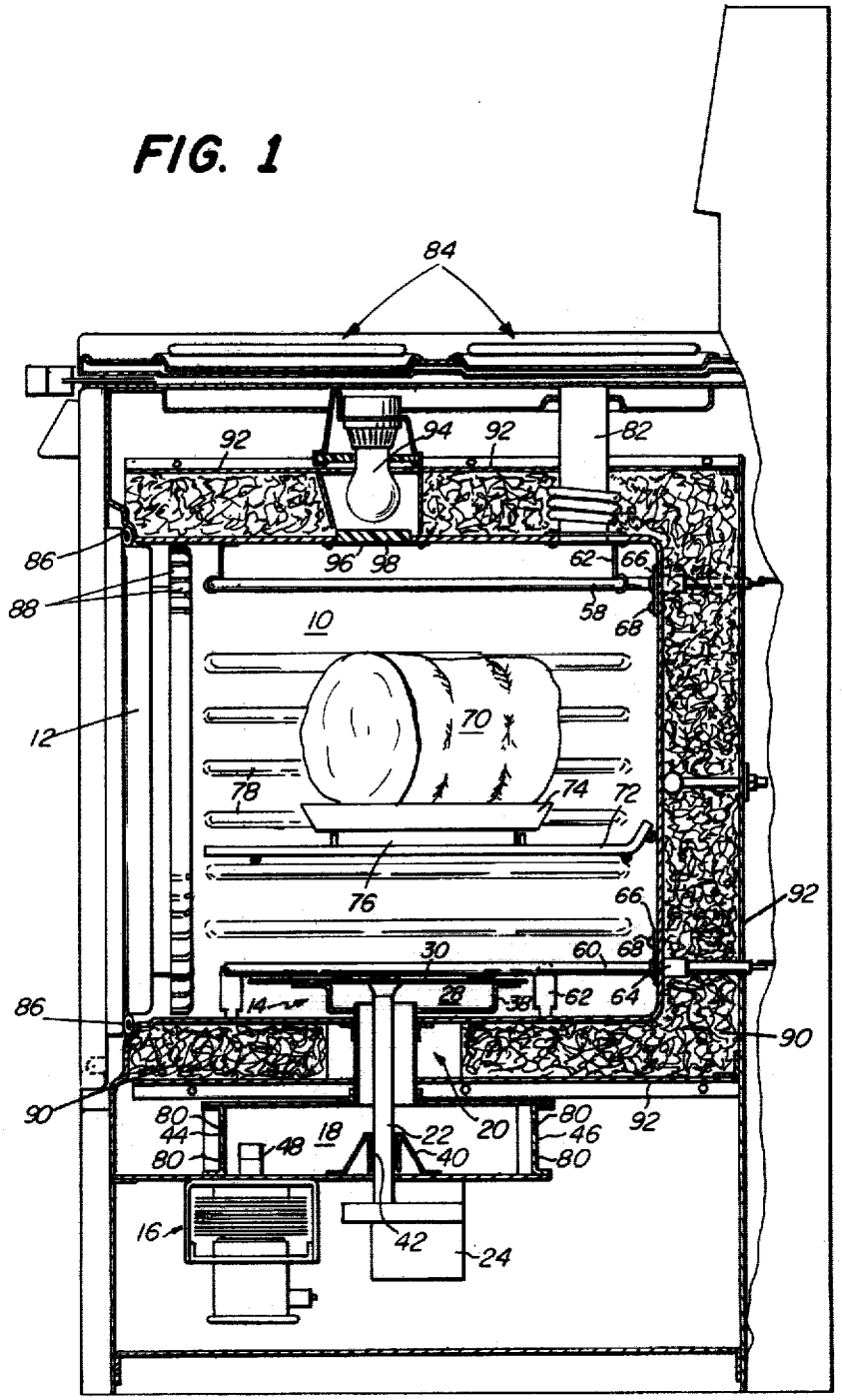
FIG. 1 illustrates a vertical sectional view of a combination microwave oven embodying the invention taken along line 1—1 of FIG. 2.
Figure 2:
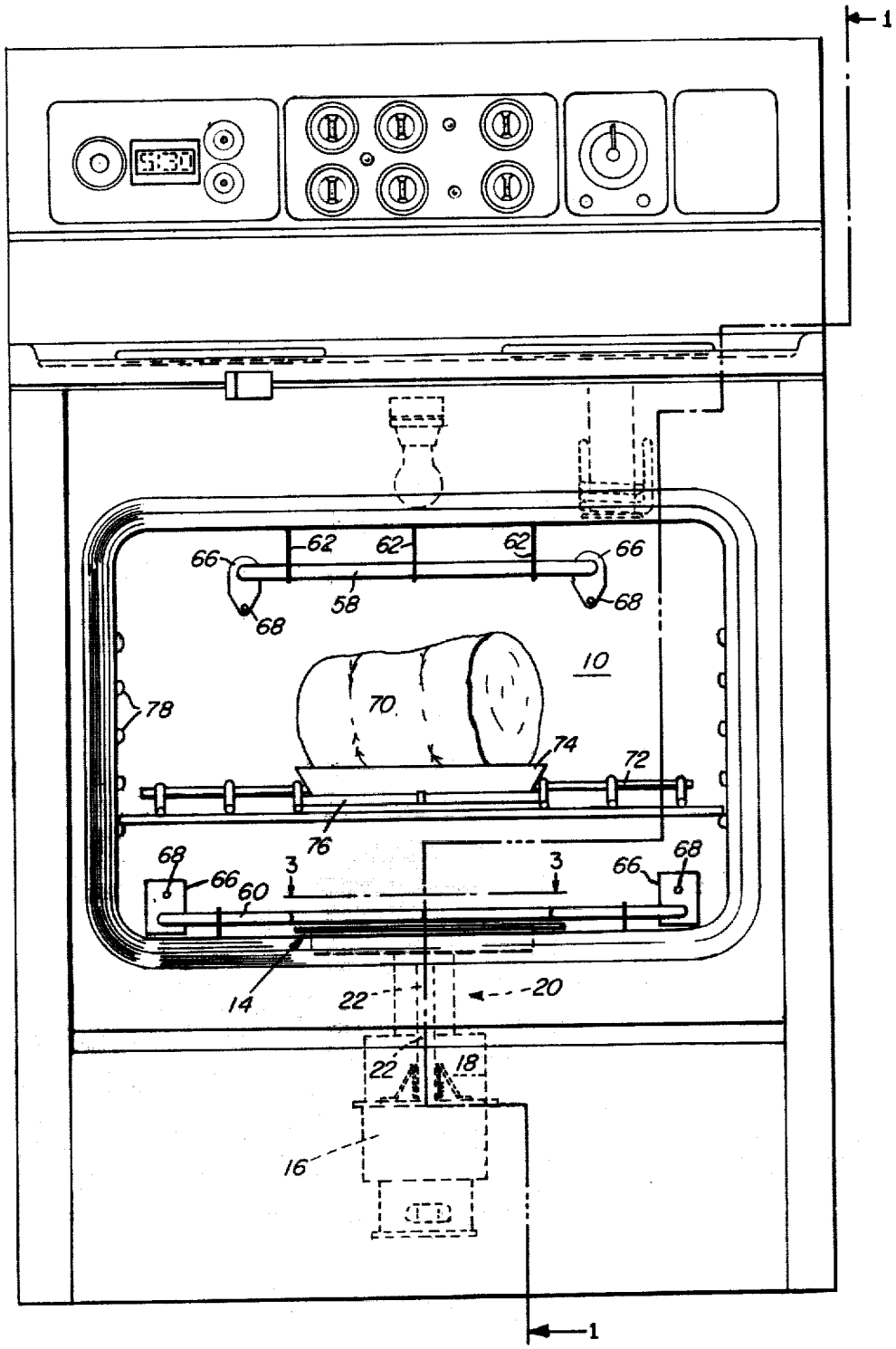
FIG. 2 illustrates a front view of the oven illustrated in FIG. 1 with the door removed.

Referring now to FIGS. 1 and 2, there is shown a microwave cavity 10 closed by a door 12 and supplied with microwave energy from a rotating radiator 14 in the bottom of the oven. Radiator 14 is fed with microwave energy from a magnetron 16 through a waveguide 18 and a coaxial line 20 having a central conductor 22 rigidly connected to rotating radiator 14 and extending through waveguide 18 to a gear reduction motor 24. Motor 24 is attached to the bottom of waveguide 18 and rotates central conductor 22 to rotate radiator 14. Coaxial line 20 has an outer conductor 26 rigidly connected to the upper wall of waveguide 18 and extending through the bottom wall of enclosure 10 into a plenum 28 in radiator 14.

Figure 3:
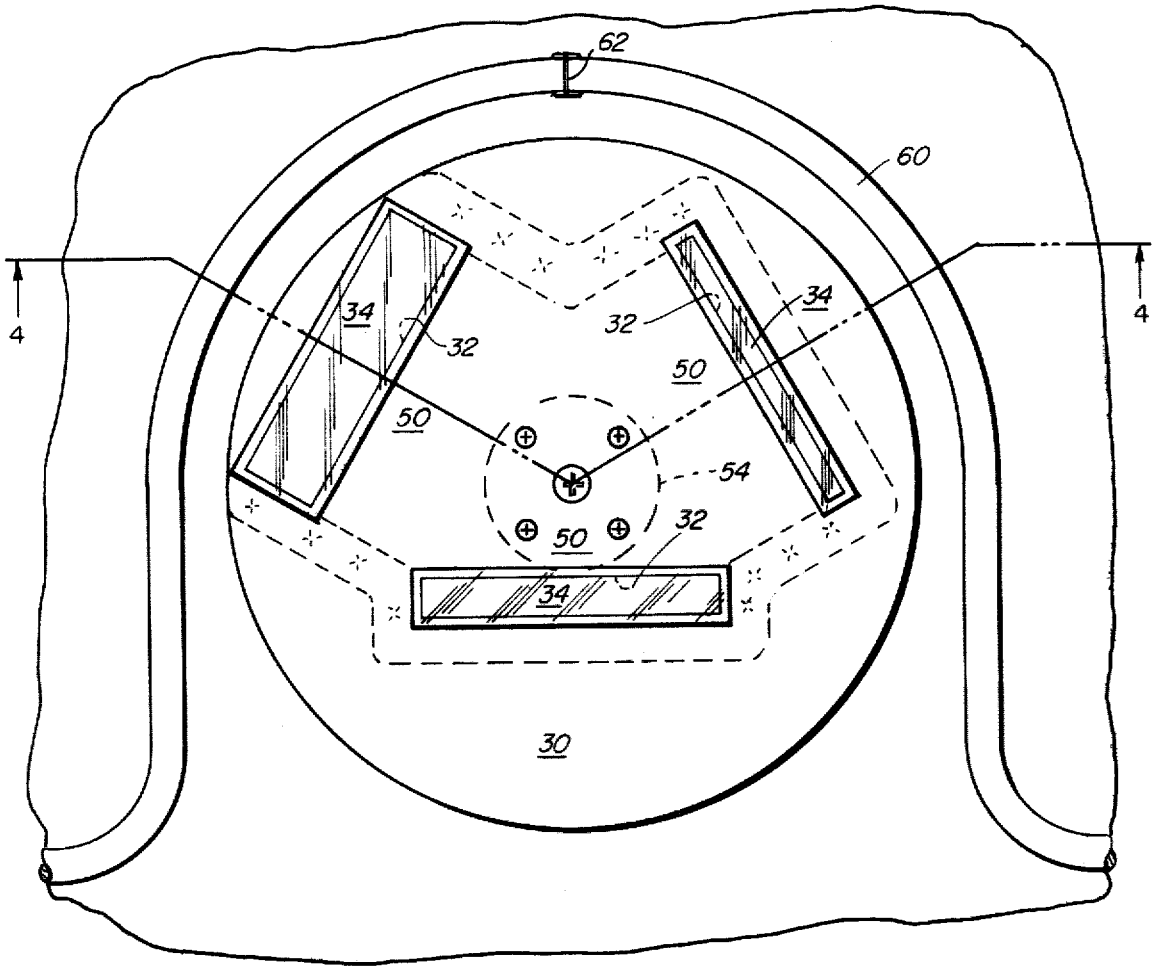
FIG. 3 illustrates a fragmentary transverse sectional view of the oven of FIG. 1 taken along line 3—3 of FIG. 2.
Figure 4:
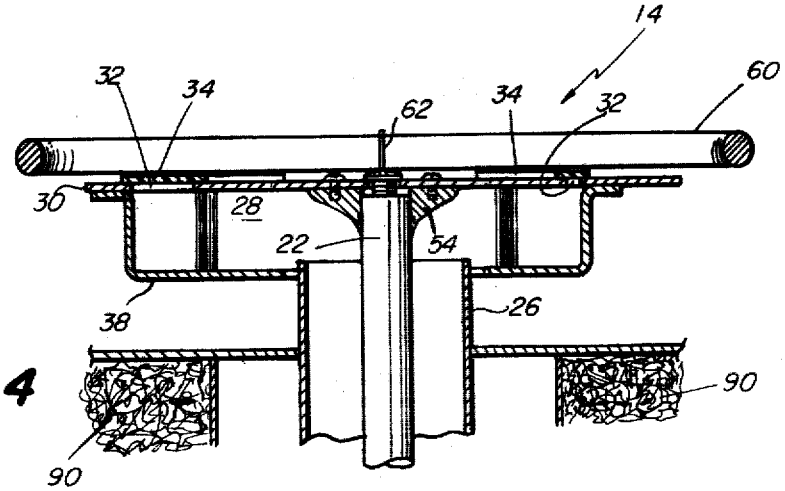
FIG. 4 illustrates a sectional view of the radiator illustrated in FIG. 3 taken along line 4—4 of FIG. 3.

As shown more specifically in FIGS. 3 and 4, plenum 28 comprises an upper plate 30 connected to central conductor 22 and having a plurality of ports 32 therein spaced at different distances at the axis of conductor 22. Microwave energy is radiated from plenum 28 into the oven enclosure 10 through ports 32 which are covered by ceramic members 34 and, hence, are transparent to microwave energy and prevent dust and cooking particles from entering the plenum 28.

A lower plenum cover 38 of radiator 14, which prevents radiation of microwave energy radially outwardly and directs it through the ports 32, and the lower surface of cover 38 is positioned sufficiently above the bottom wall of enclosure 10 for radiator 14 to rotate freely. An aperture in cover 38 surrounds the upper end of outer coaxial conductor 26 which thus extends slightly into plenum 28 thereby substantially preventing microwave energy from radiating into enclosure 10 from beneath radiator 14. The length of outer conductor 26 which extends into plenum 28 may be adjusted to improve impedance matching conditions.

As shown in FIG. 1, a substantially conical waveguide to coaxial line transition member 40 is formed of sheet metal and attached to the bottom wall of guide 18 surrounding central conductor 22. Transition 40 extends from the bottom wall upwardly along conductor 22 for distances equal to an effective electrical quarter wavelength at the frequency of magnetron 16 so that it produces a choking action to energy attempting to escape from waveguide 18 toward motor 24. A bearing 42 of dielectric material is positioned between transition 40 and conductor 22 to insure against arcing in the bearing.

The ends of waveguide 18 are closed by shorting members 44 and 46 respectively which are adjusted to provide a substantially flat standing wave ratio between the output probe 48 of magnetron 16 and central conductor 22.

As shown in FIGS. 3 and 4, radiator ports 32 are each fed with microwave energy through separate waveguide sections 50 whose axes are at 120° to each other and whose inner ends form a common junction region containing the central conductor 22. An impedance matching conical member 54 is connected to conductor 22 to increase its radius as it approaches upper plate 30 of plenum 28. Waveguides 50 have side walls forming the sides of plenum 28 and are of different lengths with the maximum length difference being on the order of $\lambda/3$ or less to that energy radiated into plenum 28 from central conductor 22 arrives at ports 32 in respectively different phases. Since the width of guides 50 is selected to be between $\frac{2}{3}\lambda$ and $\lambda$, the primary mode excited in waveguides 50 is the $TE_{1\text{-}0}$ mode; and since the ports 32 are slots extending across the guides 50, the radiation patterns radiated from each of the ports will have different polarizations.

Energy reflected back to the ports 32, for example, from the top wall of the microwave cavity 10 will couple into the ports 32 dependent upon the polarization and will propagate toward the common junction at central conductor 22. However, as a result of the different distances that the waves travel, which distance differences are double the length differences of waveguides 50, the waves will arrive at central conductor 22 in different phases preferably selected so that substantial cancellation of the electrical field vector will occur thereby causing this junction of the waveguides 50 at central conductor 22 to reflect such energy back through ports 32 into the cavity. As a result, a substantial isolation of the magnetron from reflected waves occurs. Furthermore, while this effect is preferably chosen to be maximized when the microwave cavity has no food body positioned therein and the geometry of the oven is fixed, substantial amounts of cancellation will occur for light loads such as small food bodies which do not absorb substantially all the microwave radiation on the first pass of the microwave energy through the food body. Under these conditions it, therefore, is possible to couple magnetron 16 to the oven cavity 10 as tightly as possible thereby allowing magnetron 16 to operate close to its maximum efficiency for converting its electrical energy input to microwave energy output while maintaining low microwave energy field gradients and, hence, low wall losses in the waveguide 18. Such a match is achieved primarily by selecting the position of the waveguide and shorting member 44 to be on the order of an eighth of a guide wavelength from the axis of the output 48 of magnetron 16, so that energy radiated from antenna 48 toward shorting member 46 reflects toward antenna 48 in a phase adding to direct radiation therefrom for producing directional radiation from antenna 48 along guide 18 to central conductor 22. Similarly, waveguide shorting member 46 is positioned to reflect energy radiated from magnetron output 48 past conductor 22 to be out of phase with energy reflected by central conductor 22 toward magnetron output 48 and will cancel thereby assisting the impedance match between coaxial line 20 and waveguide 18. As a result, the standing wave ratio in those regions may be made close to unity, for example, being within 20 percent of unity for the majority of rotational positions of radiator 14. Therefore, peak voltage gradients which might occur due to resonance are avoided and high heating efficiency in the oven may be achieved.

In accordance with this invention, oven cavity 10 may be made of relatively lossy or energy absorbing material which may absorb, for example, a few percent of microwave energy impinging thereon and reflecting therefrom. Such material may be, for example, conventional sheet steel used in conventional ovens and coated with conventional enamel, all in accordance with well-known practice. In addition, conventional broiler and heating units 58 and 60 may be positioned adjacent the upper and lower walls of the cavity 10 held by conventional fastners 62 in accordance with well-known practice. However, in the case of the heating unit 60, it preferably is formed in arcuate shape so that its closest portion is positioned around, and spaced from, the periphery of radiator 14 so as not to interfere with the pattern of microwave energy radiated therefrom.

Elements 58 and 60 extend through the back wall of cavity 10 and have the outer covering of the calrod unit grounded to the wall of cavity 10 by tabs 66 attached, for example, by welding or crimping to the calrod unit and screwed to the back wall of cavity 10 by screws 68. Tubular elements 64, whose lengths are preferably an effective quarter wavelength the microwave frequency in cavity 10, are attached by welding to oven wall 10 and surround the calrod unit spaced therefrom by an enamel coating on element 64. Thus, microwave energy is prevented from escaping from the oven 10 through the space between the outer surface of the elements 58 and 60 and the inner surface of tubular elements 64 due to the choking action of tubular members 64. Electrical connections to power and control terminals may be made to the calrod heater and broiler units in accordance with well-known practice.

A food body 70 may be positioned, for example, on a rack 72 above radiator 14 in a dish 74 preferably transparent to microwave energy and resting on a plate 76 of material which is transparent to microwave energy such as pyroceram. Rack 72 may be, for example, a welded wire rod having apertures substantially greater than $\lambda/2$ and adjustably supported at different levels in cavity 10 by means of grooves 78 in the side walls of cavity 10 or in any other desired manner.

Any desired configuration can be used for the radiator 14. An example providing good results at 2.45 KMH using waveguides 50 which are 4 inches wide and 1 inch high, fed by a central conductor 22 which is ½ inch in diameter and an outer conductor 26 which is 2 inches in diameter, having lengths of 1 inch, 3¼ inches, and 2 inches from the axis of conductor 22 feeding ports 32 having widths of ½ inch, ¼ inch, and 1 inch respectively. The waveguide 18, which may also be 4 inches wide, is shown as 2 inches high and the distances from shorting member 44 to the center of magnetron output 48, to the axis of conductor 22, and to shorting plate 46 are ¾ inch, 5 inches, and 10¼ inches respectively. Additional explanation of radiator 14 may be found in the aforementioned Teich application.

Air from a blower (not shown) is blown in a conventional manner through the cooling fins of magnetron 16 and then into oven 10, for example, through waveguide 18 via apertures 80 in shorting plates 46 and 44, transmission line 20 and the space between outer conductor 26 and the aperture in plate 38 where the air circulates past calrod heater 60 to conduct that air past food body 70 during cooking. The air then exits through a canister 82 at the top of the oven to the center of a surface burner unit 84.

During the oven's self-cleaning cycle with food body 70 removed, the temperature of the oven is raised to 750° F.–1,000° F. by energizing both calrod units 58 and 60 to vaporize deposits on the wall of oven 10 and to blow the vapor out through canister 82 which may contain a catalyst to complete oxidation of the vapor in accordance with well-known practice.

Door 12 has a heat seal 86, such as a tube of woven fiberglass over a tubular woven spring steel mesh, positioned between the oven wall surface and the door surface to prevent escape of hot gas from the oven. A slotted choke structure 88 on door 12 prevents microwave energy from leaking out of oven 10 around the periphery of door 12. Choke structure 88 may be of the type described in U.S. Pat. No. 3,767,884 by Osepchuk, et al. Thermal insulation 90 of, for example, fiberglass is provided around oven 10 in a well-known manner surrounded by a metal skin 92. A light 94 may illuminate oven 10 through an apertured metal plate 96 cover with pyroceram 98.

This completes the description of the embodiments of the invention disclosed herein. However, many modifications thereof will be apparent to persons skilled in the art without departing from the spirit and scope of this invention. For, example, any desired number of ports 32 can be used and means for rotating radiator 14 other than motor 24 could be used. Accordingly, it is intended that this invention be not limited to the specific embodiments disclosed herein except as defined by the appended claims.

What is claimed is:

1. A microwave heating apparatus comprising:

a substantially rectangular conductive enclosure having an aperture in a wall thereof;

a source of microwave energy outside said enclosure;

a primary radiating structure having a chamber formed by spaced first and second surfaces, said first surface having a hole therein, said structure being supported in said enclosure by a conductive rod extending into said enclosure through said aperture, said rod extending through said hole and contacting said second surface for supporting said structure;

a conductive cylinder positioned concentric with said rod and extending from said aperture into said chamber for providing a coaxial transmission line in combination with said rod for coupling said microwave energy to said chamber;

means for rotating said primary radiating structure about the axis of said rod;

and said primary radiating structure comprising a plurality of radiators for radiating simultaneous beams of said microwave energy, said beams having differently oriented polarization vectors in a plane substantially perpendicular to said axis.

2. The apparatus recited in claim 1 wherein said chamber comprises a plurality of waveguides extending radially from said axis to slot antennas in said second surface.

3. The apparatus recited in claim 2 wherein said slots are positioned at different distances from said axis.

4. The apparatus recited in claim 1 wherein three simultaneous beams are radiated.

5. The apparatus recited in claim 4 wherein said beams have polarization vectors differing by 120° from each other.

6. The apparatus recited in claim 1 wherein said rotating means comprises a motor for rotating said rod.

7. A microwave heating apparatus comprising:

a substantially rectangular conductive enclosure having an aperture in a wall thereof;

a source of microwave energy outside said enclosure;

a primary radiating structure having a chamber formed by a disc having slots therein and a dish having at least a portion spaced from said disc, said portion having a hole therein, said structure being positioned in said enclosure;

a conductive rod extending into said enclosure through said aperture, said rod extending through said hole and contacting said disc on the opposite side of said chamber for supporting said radiating structure;

a conductive cylinder positioned concentric with said rod and extending from said aperture into said chamber through said hole for providing a coaxial transmission line in combination with said rod for coupling said microwave energy to said chamber ;

means for rotating said primary radiating structure about the axis of said rod; and said primary radiating structure radiating a plurality of simultaneous beams of said microwave energy through said slots, said beams having differently oriented polarization vectors in a plane substantially perpendicular to said axis.

8. The microwave heating apparatus recited in claim 7 wherein said slots are different distances from said axis.

9. The apparatus recited in claim 7 wherein said rotating means comprises a motor coupled to said rod.

10. The apparatus recited in claim 7 wherein there are three slots.

11. The apparatus recited in claim 10 wherein said slots are approximately 120° in orientation from the other slots.

* * * * *